US007014428B2

(12) United States Patent
Pitla et al.

(10) Patent No.: US 7,014,428 B2
(45) Date of Patent: Mar. 21, 2006

(54) CONTROLS FOR VARIABLE DISPLACEMENT COMPRESSOR

(75) Inventors: Srinivas S. Pitla, Ann Arbor, MI (US); Yong Huang, Northville, MI (US); Vipen Khetarpal, Novi, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 183 days.

(21) Appl. No.: 10/328,416

(22) Filed: Dec. 23, 2002

(65) Prior Publication Data

US 2004/0120829 A1 Jun. 24, 2004

(51) Int. Cl.
*F04B 1/26* (2006.01)

(52) U.S. Cl. ..... 417/222.2; 417/269; 417/310; 417/270; 92/71; 92/12.2; 184/6.17; 184/26

(58) Field of Classification Search ..... 417/222.2, 417/296, 310, 269, 313, 270; 92/71, 12.2; 184/6, 17, 26
See application file for complete search history.

(56) References Cited

U.S. PATENT DOCUMENTS

| | | | | |
|---|---|---|---|---|
| 3,772,888 | A | 11/1973 | Orlando | |
| 3,977,424 | A | 8/1976 | Patton | |
| 5,027,612 | A | 7/1991 | Terauchi | |
| 5,577,894 | A | 11/1996 | Kawaguchi et al. | |
| 5,893,706 | A | 4/1999 | Kawaguchi et al. | |
| 5,997,257 | A | 12/1999 | Ishida et al. | |
| 6,010,314 | A * | 1/2000 | Kobayashi et al. | 417/222.2 |
| 6,015,269 | A * | 1/2000 | Ota et al. | 417/222.2 |
| 6,045,337 | A | 4/2000 | Tokumasu | |
| 6,149,397 | A | 11/2000 | Mizutani et al. | |
| 6,149,398 | A * | 11/2000 | Fukanuma et al. | 417/222.2 |
| 6,164,925 | A | 12/2000 | Yokomachi et al. | |
| 6,179,578 | B1 | 1/2001 | Kayukawa et al. | |
| 6,206,648 | B1 * | 3/2001 | Kimura et al. | 417/222.2 |
| 6,227,812 | B1 | 5/2001 | Kawaguchi et al. | |
| 6,234,763 | B1 | 5/2001 | Ota et al. | |
| 6,352,416 | B1 | 3/2002 | Ota et al. | |
| 6,431,053 | B1 | 8/2002 | Strikis et al. | |
| 6,508,634 | B1 * | 1/2003 | Ota et al. | 417/222.2 |
| 2002/0015645 | A1 * | 2/2002 | Yamada et al. | 417/222.2 |
| 2002/0025258 | A1 * | 2/2002 | Ota et al. | 417/222.2 |

FOREIGN PATENT DOCUMENTS

| | | |
|---|---|---|
| EP | 0 798 461 A2 | 10/1997 |
| EP | 0 798 461 A3 | 10/1998 |
| EP | 0 881 387 A2 | 12/1998 |
| EP | 0 926 341 A2 | 6/1999 |

(Continued)

OTHER PUBLICATIONS

Combined Search and Examination Report dated Apr. 19, 2004, for corresponding United Kingdom application GB 0328199.5.

(Continued)

*Primary Examiner*—Charles G. Freay
*Assistant Examiner*—Emmanuel Sayoc
(74) *Attorney, Agent, or Firm*—Brinks Hofer Gilson & Lione

(57) ABSTRACT

A control system for a variable displacement compressor uses a mechanical valve to minimize energy consumption in an air conditioning system. The control system can also provide instantaneous indications to the vehicle controller of air conditioning power consumption to avoid engine loading. Controls are also used to contain oil within the compressor and to minimize its presence downstream of the compressor into the gas cooler and evaporator parts of the system.

17 Claims, 7 Drawing Sheets

FOREIGN PATENT DOCUMENTS

| | | | |
|---|---|---|---|
| EP | 0 926 346 | A3 | 6/1999 |
| EP | 0 935 107 | A2 | 8/1999 |
| EP | 0 940 581 | A2 | 9/1999 |
| EP | 0 940 581 | A3 | 4/2000 |
| EP | 1 020 641 | A2 | 7/2000 |
| EP | 1 020 641 | A3 | 7/2000 |
| EP | 1 034 951 | A2 | 9/2000 |
| EP | 1 020 641 | A3 | 12/2000 |
| EP | 1 059 444 | A2 | 12/2000 |
| EP | 1 059 445 | A2 | 12/2000 |
| EP | 1 059 446 | A2 | 12/2000 |
| EP | 1 099 852 | A2 | 5/2001 |
| EP | 1 099 852 | A3 | 5/2001 |
| EP | 1 126 169 | A2 | 8/2001 |
| EP | 1 138 932 | A2 | 10/2001 |
| EP | 1 138 946 | A2 | 10/2001 |
| EP | 0 935 107 | A3 | 1/2002 |
| EP | 1 034 951 | A3 | 1/2002 |
| EP | 1 167 762 | A3 | 1/2002 |
| EP | 1 207 301 | A3 | 5/2002 |
| EP | 1 059 444 | A3 | 6/2002 |
| EP | 1 059 445 | A3 | 6/2002 |
| EP | 1 059 446 | A3 | 6/2002 |
| EP | 1 099 852 | A3 | 8/2003 |
| EP | 1 363 023 | A2 | 11/2003 |
| JP | 590 77 086 | | 2/1984 |
| JP | 2000-9044 | | 1/2000 |
| WO | WO 99/25977 | | 5/1999 |
| WO | WO 99/66203 | | 12/1999 |
| WO | WO 01/53699 | A1 | 1/2001 |

OTHER PUBLICATIONS

Search report for corresponding GB application, GB0328199.5, dated Oct. 8, 2004.

* cited by examiner 82
68
69
62
71
64
67
77
73
66
75
78
80
(MAXIMUM A/C)
90a
70
58a
72
46a
74
56a
76
60

24
113
24
86
91
115
84
111

113
24
86
115
111
91
84

(MAXIMUM FLOW)

(MINIMUM/OFF)

CONTROLS FOR VARIABLE DISPLACEMENT COMPRESSOR

FIELD OF THE INVENTION

This invention generally relates to variable displacement compressors for air conditioning systems in automobiles and trucks. Variable displacement compressors are used in air conditioning systems with clutchless and clutched compressors.

BACKGROUND OF THE INVENTION

Automotive air conditioning systems, like all air conditioning systems, are faced with a number of operating contradictions. These contradictions include a requirement to provide cooling, but not too much cooling, in the passenger compartment. There is a technical requirement to lubricate the refrigerant compressor, but not to foul downstream heat exchangers with the lubricant. In automotive systems, additionally, consumers expect instantaneous response in the passenger compartment to what may be a very large and very rapidly changing heat load. Of course, while the only power available is that supplied by the engine and the automotive battery, automotive consumers also expect that operation of the air conditioning system will not load the engine or cause any operating difficulty. Consumers also expect that the automotive air conditioning system will have low power consumption.

Traditional automotive air conditioning systems used a clutch, in which the air conditioning compressor was engaged or disengaged to provide power to the compressor and thus supply cooling to the passenger compartment. Of course, the on/off nature of this control provided slow response. The prior art tried to meet the needs described above in a variety of ways, principally by using a variable displacement compressor. In clutchless variable displacement compressors, the compressor is always on, i.e. always rotating, while the displacement of the compressor is determined by the angle at which a central swashplate is oriented to a number of pistons and cylinders in which refrigerant compression takes place. A narrow angle (perpendicular to a drive shaft) provides little compression, while steep angles (at some angle to the drive shaft) provide greater compression, depending on the angle selected. However, some present variable displacement compressors allow too much oil into the downstream air conditioning components, such as the gas cooler or condenser, and the evaporator, fouling their internal surfaces and reducing heat transfer to the passenger compartment. In addition, high loads on the compressors can load down engines, in extreme cases causing stalling in awkward situations. Finally, the response time for systems using variable displacement compressors can be long, resulting in longer cooling cycles and higher power consumption than necessary. What is needed is a control system that responds rapidly to air conditioning loads and minimizes oil contamination and energy consumption, without loading the engine or causing stalling.

SUMMARY

This invention meets these needs by providing an improved control system for an automotive air conditioning system. While the greatest advantage for the improved control system may be realized in a clutchless variable displacement compressor for an automotive air conditioning system, the control system may also be utilized in a variable displacement compressor having a clutch.

One aspect of the invention is a variable displacement compressor. The variable displacement compressor comprises a compressor housing having a crankcase chamber with a crankcase pressure, a suction chamber with a suction pressure, and a discharge chamber with a discharge pressure, the compressor also having a driveshaft, a swashplate connected to and driveable by the driveshaft, a plurality of pistons connected to the swashplate and reciprocating in a plurality of cylinders, wherein a displacement of the compressor is varied by the angle of the swashplate with the drive shaft. The compressor also comprises a three-way control valve having a valve body and a valve stem, at least one spring opposing motion of the valve stem, and three chambers in series for receiving three pressures from the variable displacement compressor, one chamber receiving a discharge pressure, one chamber receiving a crankcase pressure, and one chamber receiving an auxiliary pressure, wherein the control valve is operative to change the crankcase pressure and thereby change the displacement of the compressor.

Another aspect of the invention is a method of operating a variable displacement compressor. The method comprises controlling a displacement of the compressor with a three way valve using a discharge pressure, a crankcase pressure, and an auxiliary pressure, and adjusting the displacement with the three way valve based on a difference between the discharge pressure and the crankcase pressure. The method also comprises separating oil from a discharge line of the compressor; and routing the oil to a crankcase of the compressor.

Another aspect of the invention is a variable displacement compressor. The variable displacement compressor comprises a compressor housing having a crankcase chamber with a crankcase pressure, a suction chamber with a suction pressure, and a discharge chamber with a discharge pressure, the compressor further comprising a driveshaft, a swashplate connected to and driveable by the driveshaft, a plurality of pistons connected to the swashplate and reciprocating in a plurality of cylinders, wherein a displacement of the compressor is varied by the angle of the swashplate with the drive shaft. The variable displacement compressor also comprises an oil separator in a discharge line of the compressor, and a four-way control valve having a valve body and a valve stem, at least one spring opposing motion of the valve stem, and four chambers in series for receiving an oil separator pressure, a discharge pressure, a crankcase pressure, and a suction pressure from the variable displacement compressor, with an orifice connecting the crankcase chamber with the suction chamber, wherein the control valve is operative to change the crankcase pressure and thereby change the displacement of the compressor.

Another aspect of the invention is a method of operating a variable displacement compressor. The method comprises controlling a displacement of the compressor with a four way valve having an orifice between two chambers of the valve, and adjusting the displacement using the four way valve, based on a difference between a discharge pressure and a crankcase pressure. The method also comprises separating oil from a discharge line of the compressor; and routing the oil to a crankcase of the compressor.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 1:
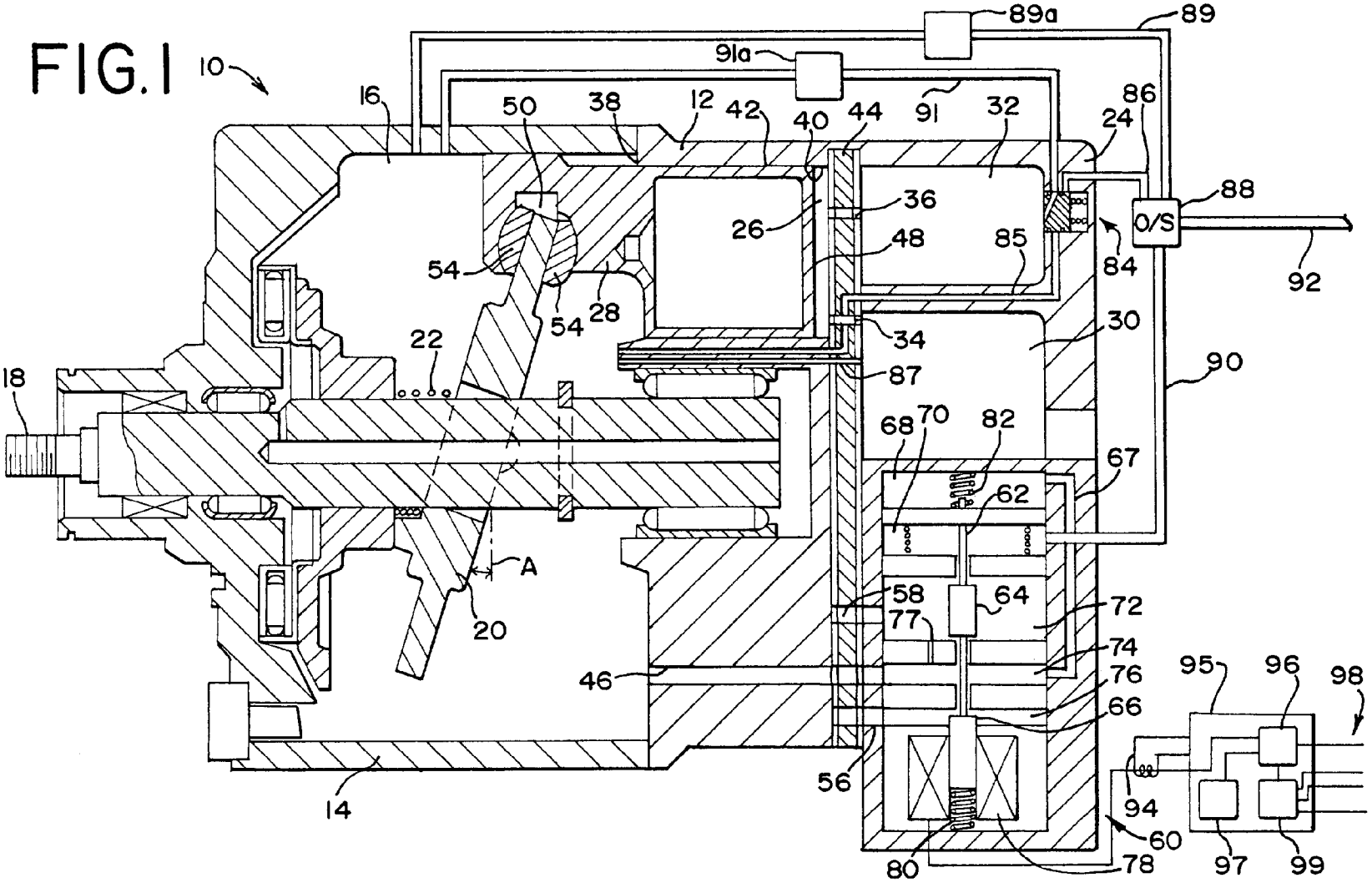
FIG. 1 depicts a cross-sectional view of a first embodiment having a four-way control valve.

FIG. 1 illustrates a variable displacement type compressor, generally indicated in the drawings as reference 10. The compressor 10 includes a cylinder block 12, a housing 14 that defines a crank chamber 16, a drive shaft 18, a swashplate 20, a swashplate spring 22, a rear housing 24, at least one cylinder bore 26, and at least one piston 28. The rear housing 24 defines a suction chamber 30 and a discharge chamber 32. There is a valve plate 44 that defines a suction port 34 and a discharge port 36 for each cylinder. The compressor comprises a plurality of pistons and cylinders, for example, 5 pistons and cylinders, or 6 pistons and cylinders. The drive shaft 18 is supported by the housing 14 such that a portion of the drive shaft 18 is disposed within the crank chamber 16. The swashplate 20 is mounted on the drive shaft 18 such that it is contained within the crank chamber 16 and is tilted away from a plane perpendicular to the longitudinal axis of the drive shaft 18. The degree to which the swashplate 20 is tilted away from the plane perpendicular to the longitudinal axis of the drive shaft 18 is indicated in the drawing as angle A. A spring 22 acts upon swashplate 20. The cylinder block 12 defines the cylinder bore 26. The piston 28 is disposed within the cylinder bore 26 such that the piston 28 can slide in and out of the bore 26. This slideable movement of the piston 28 is possible, at least in part, due to the presence of a small clearance 38 between the interior surface 40 of the cylinder block 12 in the cylinder bore 26 and the exterior surface 42 of the piston 28. The pistons 28 may be secured to the swashplate 20 by shoes 54, which allow for movement of the swashplate relative to the pistons.

System Controls

There is a solenoid valve 60, comprising a stem 62 and two flow control elements 64, 66 fixed on the stem. The valve defines five chambers 68, 70, 72, 74, 76 for controlling the operation of the variable displacement compressor 10. Passage 67 communicates $P_c$ from chamber 74 to chamber 68. In this embodiment, chambers 68 and 74 are thus at crankcase pressure, $P_c$, while chamber 70 is at the pressure of an oil separator, $P_{os}$, which will be described below. Chamber 72 is at discharge pressure, $P_d$, and chamber 76 is at the compressor suction pressure, $P_1$. Orifice 77, about 0.4 mm to about 1.0 mm diameter, communicates between chambers 72 and 74. In some embodiments, a pressure of refrigerant gas returning from the evaporator, $P_{ev}$, may be used in place of $P_s$. The solenoid has a coil 78 which receives power from an external power source. The solenoid valve also has springs 80 and 82 at opposite ends of the stem to balance the forces on the stem 62. Spring 80 is larger (having a greater spring constant) than spring 82, so that when there is no current to the coil 78, spring 80 urges the stem upward.

As shown in FIG. 1, there is sufficient current to coil 78 so that it has been drawn downward, allowing communication between chamber 70 ($P_{os}$) and chamber 72 ($P_d$), and also between chamber 72 ($P_d$) and chamber 74 ($P_c$) and between chamber 74 ($P_c$) and chamber 76 ($P_s$). In this configuration, the swashplate will be at angle A, an intermediate position between its minimum angle (almost parallel to a plane perpendicular to the longitudinal axis of the drive shaft 18) and its greatest angle, which will vary according to the particular compressor used, but may be as great at 30 degrees. With this geometry, the control of valve 60 depends primarily on the difference between discharge pressure $P_d$ and $P_s$. Because $P_d$ is much more active and variable than $P_s$, this valve, and thus the compressor, is able to react more quickly to changes in cooling demand by the cooling load in the automobile or truck of which the compressor and air conditioning system is a part. This quick reaction is much faster, for instance, than a valve which connects the $P_c$ and $P_s$ chambers.

The compressor system may also include a control system 95, including a microprocessor-based controller 96 and memory 97, and signal-conditioning circuitry 99 that controls the current to the solenoid coil 78. The microprocessor-based controller may include any useful controller, including PID or other types of controllers, and also desirably includes a pulse-width-modulation (PWM) routine for very quickly controlling the current to the solenoid. The controller may have a number of inputs/outputs 98, which may include a temperature indication from the passenger compartment and may also indicate a relative humidity from the passenger compartment. The controller may control and also monitor the current to the solenoid by a current-reading device 94, which may be internal or external to the controller. The solenoid current is proportional to the load on the compressor and the air conditioning system. In one embodiment, the control system 95 may send an indication of the solenoid current or solenoid valve position to the vehicle powertrain control module for indicating the load on the compressor, and thus on the vehicle, caused by the air conditioning system.

System Operation

When the swashplate is at its minimum angle, the pistons reciprocate to the least extent possible as the drive shaft rotates, compressing the smallest possible amount of refrigerant in the compressor, and using the least energy. When the swashplate is at its greatest angle, the pistons reciprocate up and down in their respective cylinders to the maximum extent, compressing much more refrigerant, and allowing the greatest air-conditioning effect. To achieve the greatest swashplate angle, the solenoid pulls the stem and flow control elements even further down in FIG. 1, so that flow control element 64 closes communication between chamber 72 ($P_d$) and chamber 74 ($P_c$). The desired amount of cooling by the air conditioning system and the compressor, and the degree of travel of the stem and flow control elements in valve 80, correspond with the current needed for the coil 78. In one embodiment, control system 95 and microprocessor-based controller 96 includes a pulse-width-modulation (PWM) routine for controlling the movement of solenoid valve 60. In PWM routines, a current is switched on and off, typically at a varying frequency, to achieve a desired control output by means of very fast switching between on and off. For instance, a square-wave pattern with short "off" periods may be used with longer and longer "on" periods to simulate a sinusoidal current. When the current is on, the valve stem is pulled downward, and the valve closes. When the current is off, spring 80 overcomes the force of spring 82, and the valve opens. This allows the valve to be very fast-acting and very responsive to the control signal, in this case, the difference between $P_d$ and $P_s$.

The compressor has a number of passages to allow for communication of refrigerant pressure, and also for flow of refrigerant in, the compressor. Passage 46 communicates crankcase pressure $P_c$ from the crankcase 16 to chamber 74 of the valve 60. Passage 56 communicates suction pressure ($P_s$) to chamber 76 of the valve. Passage 58 communicates discharge pressure ($P_d$) from the discharge chamber to chamber 72 in valve 60. In one embodiment, passage 58 may be a short passage from 1 to about 5 mm in diameter, preferably about 2-3 mm in diameter. Within the valve, chamber 68 communicates with chamber 74 and receives crankcase pressure ($P_c$) through optional passageway or piping 67. Orifice 77 allows a flow of oil from chamber 72 at $P_d$ to chamber 74 at $P_c$, and to the crankcase itself. In addition, there may be a passage 85 from check valve 84 to crankcase 16, and there may also be an additional passage 87 from the crankcase 16 to the suction chamber 30. Passage 85 enables oil and refrigerant from the discharge to return to the crankcase. Passage 85 is from about 1 mm to about 5 mm, preferably 2 mm to 3 mm. Passage 87 allows flow between the crankcase and the suction. Passage 87 may be from 0.25 to 2 mm in diameter, preferably 0.8 mm. The passage itself may be long or may be as short as 2–4 mm.

Refrigerant compressed by the compressor leaves the discharge chamber 32 via check valve 84. Piping 86 may convey the compressed refrigerant to an oil separator 88, to prevent oil from entering the refrigeration system downstream of the oil separator 88. Refrigerant leaves to a gas cooler or condenser (not shown) via plumbing 92 while oil is returned in oil return line 89 with flow control device 89*a*. Flow control device 89*a* may be an orifice or may be an electronic valve. The oil return line desirably returns to the crankcase, where oil is needed to lubricate the working parts of the compressor, especially the pistons, cylinders, shoes and drive shaft. The check valve may also have an oil return line 91 with flow control device 91*a* to return oil to the crankcase. Either or both of the flow control devices 89*a* and 91*a* may be orifices or electronic valves, such as solenoid valves, that may be remotely opened or closed via controller 95.

Second Embodiment

Figure 2:
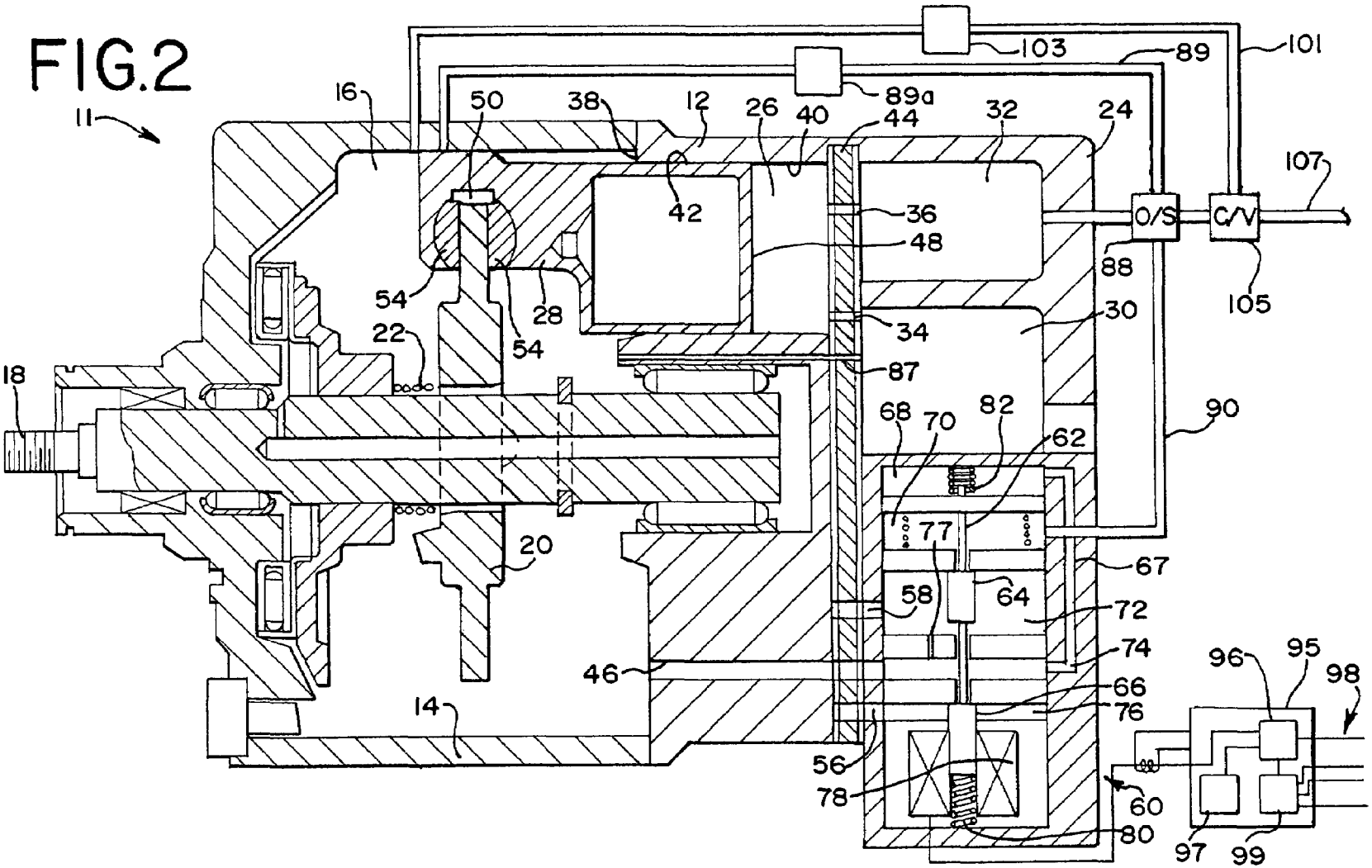
FIG. 2 depicts cross-sectional view of a second embodiment having a four-way control valve.

FIG. 2 depicts another embodiment of a variable displacement compressor 11, which is similar to the embodiment of FIG. 1. FIG. 2 is depicted with somewhat different arrangements of plumbing, and is also shown in a state in which the swashplate 20 is at its minimum angle. In this view, the swashplate in now almost vertical, and piston 28 and shoes 54 have moved to the left, revealing more of cylinder bore 26. In this position, there will be little compression of refrigerant, but all the working components within the crankcase chamber still require energy from the vehicle engine as the drive shaft continues to turn, and lubrication to prevent wear on all the moving parts. In the embodiment shown in FIG. 2, the solenoid valve 60 is shown in the closed position, with flow control element 66 preventing communication between chamber 76 ($P_s$) and chamber 74 ($P_c$), and flow control element 64 preventing communication between chamber 72 ($P_d$) and chamber 70 ($P_{os}$). Orifice 77 allows a small pressure flow between $P_d$ and $P_c$.

There may be no current from the control system 95 to the solenoid coil 78, and control system 95 may communicate this low load to the vehicle powertrain control module or to a vehicle controller. In this embodiment, the refrigerant leaves the discharge chamber 32 and is directed first to an oil separator 88 and then to a check valve 105 before leaving via plumbing 107 to the downstream air conditioning components, such as a gas cooler. The oil separated by the oil separator 88 may return via line 89 and flow control device 89*a* to the crankcase chamber 16. Flow control device 89*a* may be an orifice or may be an electronic valve. Oil may also return to the crankcase from the check valve 105 via return line 101 and flow control device 103, which may be an orifice or may be an electronic valve, such as a solenoid valve. The pressure in the oil separator may be communicated to the valve 69 via line 90.

Check Valves

Figure 3:
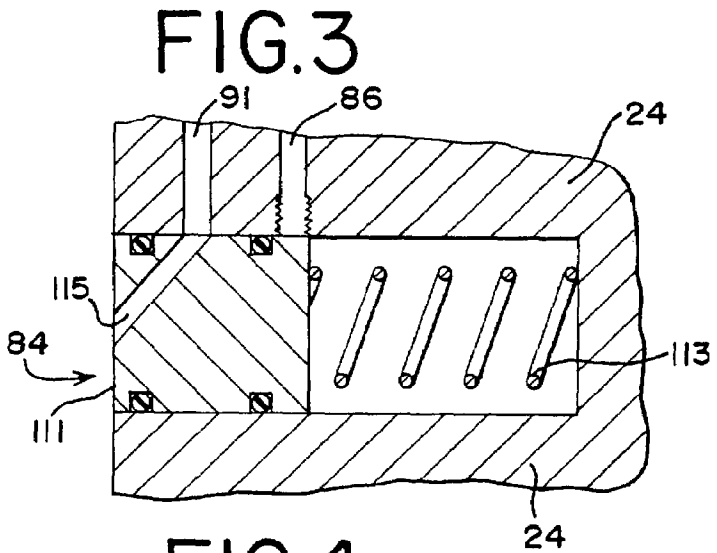
FIGS. 3 and 4 depict a cross sectional view of an embodiment of a check valve useful in the present invention.
Figure 4:
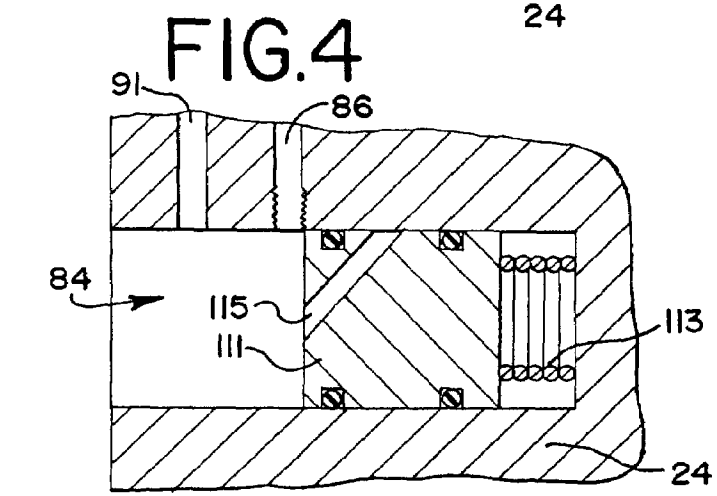

FIGS. 3 and 4 show details of the check valve 84 shown in FIG. 1. This check valve checks flow until the pressure, in this case discharge pressure, $P_d$, reaches a certain level. The check valve may be tailored by selection of spring 113 to allow flow only when the pressure has reached the desired level. In this embodiment, the check valve may be installed within the walls of rear chamber 24. FIG. 3 depicts the check valve closed, while FIG. 4 depicts the valve open, allowing refrigerant to flow via passage 86. In FIG. 3, the valve is closed, with flow control element 111, urged by spring 113, preventing passage of refrigerant from the discharge chamber 32 through piping 86. Even in this configuration, however, there may be a narrow passage or orifice 115 within the flow control element 111, to allow condensed oil to flow through orifice 115 to oil return line 91. Orifice 115 is desirably narrow, about 0.1 mm, but may range from about 0.1 mm to about 0.4 mm.

FIG. 4 depicts the check valve 84 in an open position, indicating that the discharge pressure of the refrigerant has reached a point sufficient to overcome the spring 113, which is shown in a compressed state. Refrigerant can now freely pass through piping 86. Check valve 84 or its flow control element 111 may also use O-rings as shown, or other sealing devices as needed, such as piston rings.

Solenoid Valves

Figure 5:
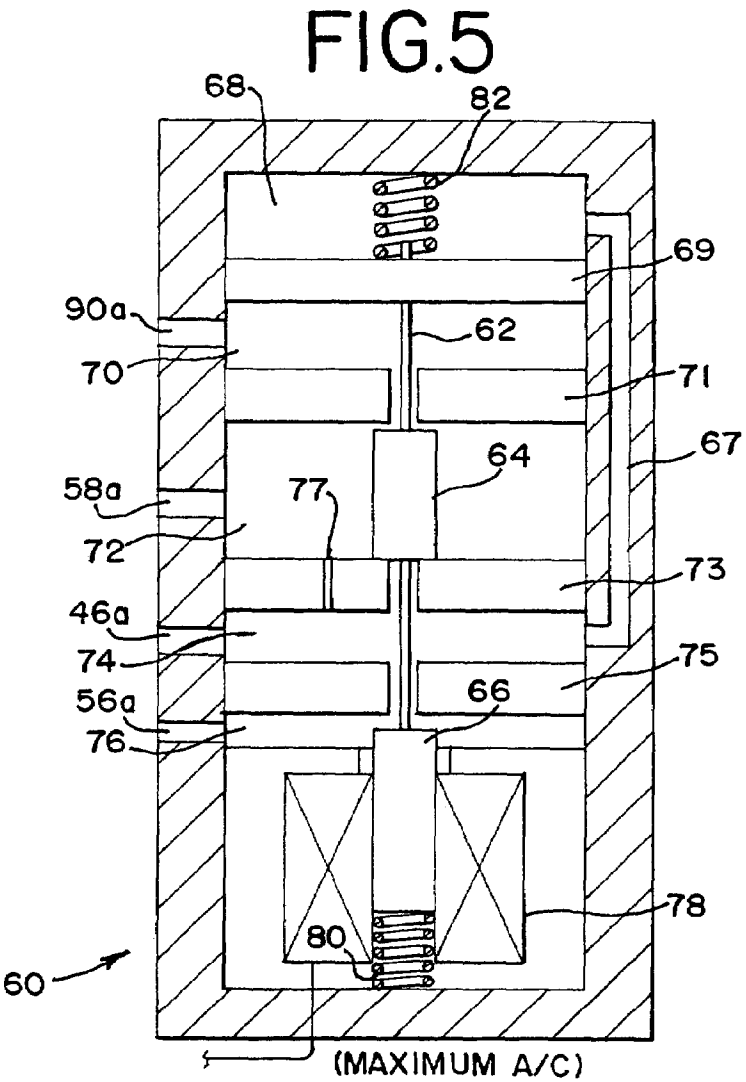
FIG. 5 is a closer cross-sectional view of a four-way valve for the first and second embodiments.

FIG. 5 is a larger, cross-sectional view of a preferred embodiment of a solenoid valve 60 used in FIGS. 1 and 2. As stated above, the valve is a very fast acting solenoid valve, preferably controlled by a PWM routine using 400 Hz with the microprocessor-based controller 96. The output of the controller is current to solenoid coil 78. The current causes stem 62 to move up or down, along with its flow control elements 64 and 66. The stem is also urged in one direction by a larger spring 80 and in an opposite direction, by smaller spring 82. When there is no current to the coil, spring 80 with a larger spring constant is able to overcome spring 82 with a smaller spring constant and close the valve.

Within the valve are five chambers, 68, 70, 72, 74 and 76. The chambers receive pressures as discussed above, and are separated by valve head 69 and valve body internal walls 71, 73, 75. The internal walls have orifices as shown to allow passage of the stem 62 and also to allow pressure to communicate from one chamber to another. There is also a tube 67 to communicate $P_c$ from chamber 74 to chamber 68. The valve has orifices 90*a* for receiving an oil separator pressure, 58*a* for receiving a discharge pressure, 46*a* for receiving a crankcase pressure, and 56*a* for receiving a suction pressure. Valve head 69 is movable within the valve, urged downward by spring 82, upward by spring 80, and upward or down by stem 62. The valve is shown in the maximum open position, coil 78 at the maximum current, with flow control element 64 as far down as possible, allowing pressure to pass from chamber 70 ($P_{os}$) to chamber 72 ($P_d$) and preventing passage from chamber 72 ($P_d$) to chamber 74 ($P_c$). With flow control element 66 also at its lowest position, there is the greatest communication possible between chambers 74 ($P_c$) and 76 ($P_s$). In this position, there will be the greatest possible difference between the suction pressure and the discharge pressure. This will push the swashplate to its maximum angle, and the pistons will reciprocate to the maximum extent, thus compressing as much refrigerant as possible for the air conditioning system.

Alternate Embodiments

Figure 6:
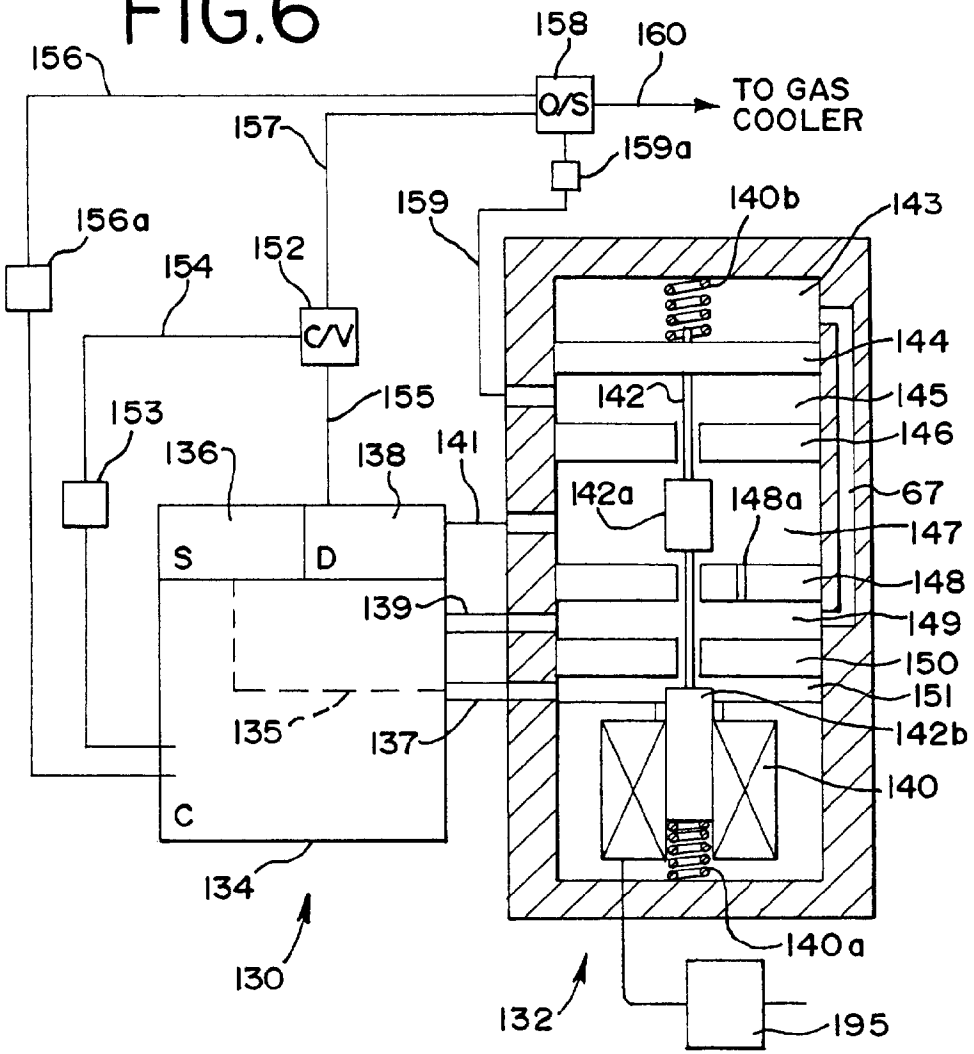
FIG. 6 is a block diagram of another embodiment showing connections of the variable displacement compressor to a four-way control valve.

FIG. 6 depicts an alternate combination of the compressor and controls. Compressor 130 and control valve 132 are connected as described above, with pressures from the compressor communicated to the valve by passages 137, 139 and 141, respectively from the compressor suction chamber 136, crankcase chamber 134, and discharge chamber 138. Passage 137 includes auxiliary passage 135 from the suction chamber. Valve 132 comprises coil 140, stem 142 and flow control elements 142*a* and 142*b*, as described above. Valve 132 also comprises chambers 143, 145, 147, 149 and 151, the chambers separated by movable valve head 144 and valve body internal walls 146, 148, 150. Tubing 67 communicates $P_c$ from chamber 149 to chamber 143. Passage 148*a* allows for a small flow from chamber 149 at $P_c$, to chamber 147, at $P_d$. Control system 195 controls valve 132.

In this embodiment, refrigerant leaves discharge chamber 138 via line 155 to check valve 152. Check valve 152 may also be equipped with a return line 154 to return oil to the crankcase 134. Line 154 may have a flow control device 153 to regulate the flow of return oil. Flow control device 153 may be an orifice or may be an electronic control valve controlled by control system 195. After check valve 152, the refrigerant may flow via line 157 to oil separator 158 and then to the refrigeration system via line 160. In one embodiment line 160 is preferably tubing about 5 mm in diameter, but tubing of other diameters may also be used, so long as too great a pressure drop is not induced in conveying the hot, compressed gas from the compressor to the other components of the vehicle refrigeration system.

The oil separator may have an oil return line 156 and flow control device 156*a* to return oil to the compressor crankcase section 134. Flow control device 156*a* may be an orifice or may be an electronic control valve controlled by control system 195.

In one embodiment, the flow control device 156*a* is an orifice from about 0.1 mm to about 0.5 mm, preferably about 0.2 mm in diameter. $P_{os}$ may be communicated to chamber 145 via tubing 159 with flow control device 159*a*, which may be an orifice or may be an electronic control valve. In one embodiment, oil return line 156 is omitted and all oil from the oil separator 158 is returned via line 159, preferably about 3 mm in diameter, to chamber 145 in valve 132. In one embodiment, the oil return line 154 from check valve 152 is preferably about 3 mm in diameter; other diameter lines may be used.

Figure 7:
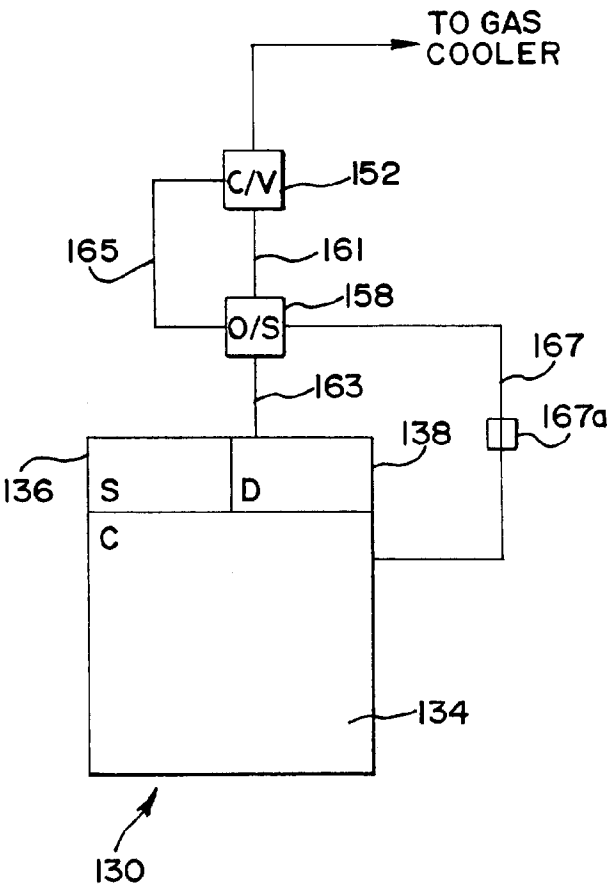
FIG. 7 is a block diagram of another alternate embodiment of a control system.

FIG. 7 depicts another arrangement of lines for the compressor 130, the oil separator 158 and the check valve 152. In this embodiment, the discharge chamber 138 connects to the oil separator 158 via line 163, the oil separator also having oil return line 167 with flow control device 167*a* to return oil to crankcase chamber 134. After leaving the oil separator 158, refrigerant flows to check valve 152 via line 161, with an oil return line 165 to the oil separator. Refrigerant then leaves the check valve on its way to the downstream air conditioning equipment. The compressor, check valve, and oil separator of FIG. 7, as well as other configurations of a check valve, oil separator, and return line, may be used with three-way valves as well as four-way control valves.

Three-Way Control Valves

The above embodiments have dealt mostly with four-way control valves. Other embodiments may use three-way control valves. Three way control valves may be used, for example, if the above-mentioned pressures, $P_d$ (discharge pressure), $P_c$ (crankcase pressure), and $P_s$ (supply pressure) are used to control the variable displacement of the compressor by controlling the angle of the swashplate or other controlling device, such as a wobbler plate. Three-way control valves may also be used if an auxiliary pressure is used to help control the pressures. An auxiliary pressure, $P_a$ that has been found useful is one that results from a pressure drop from $P_d$, the discharge pressure. In one embodiment using R134a, $P_d$ is from about 5 to 20 bars (1 bar is 1 atmosphere of pressure), while $P_a$ is from about 0.1 to about 1 bar below that of $P_d$. In an embodiment using R134a, a pressure that has the requisite value for the auxiliary pressure may be obtained by tapping the discharge pressure after it has gone through the control valve and associated piping, and has dropped by about 0.5 bar to about 1 bar. In a system using $CO_2$, $P_d$ is from about 50 to 160 bars, while $P_a$ is from about 0.1 to about 10 bars less than that of $P_d$. In a $CO_2$ embodiment, a pressure that has the requisite value for the auxiliary pressure may be obtained by tapping the discharge pressure after it has gone through the control valve and associated piping and has dropped by about 0.1 bar to about 10 bars.

Figure 8:
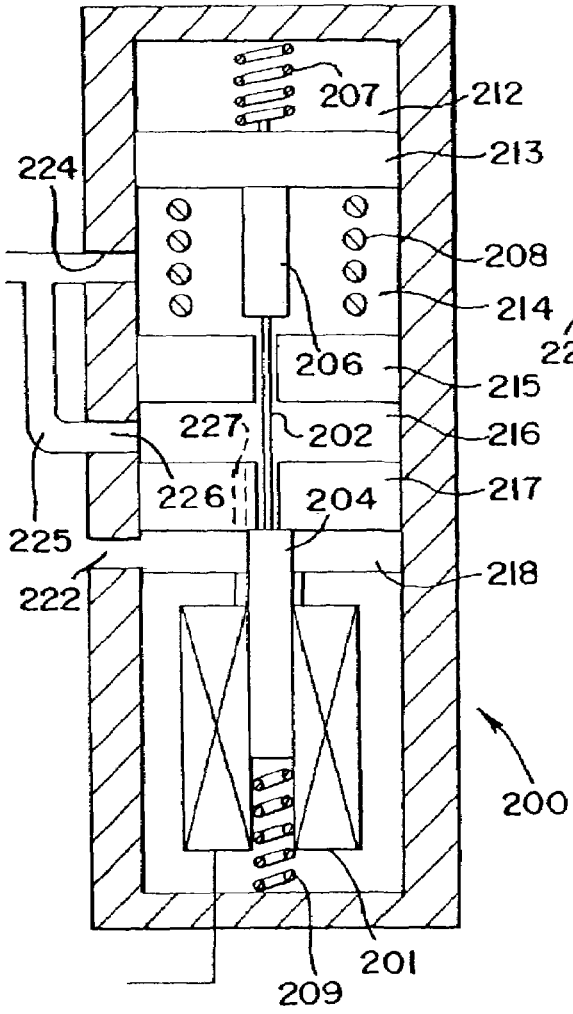
FIGS. 8 and 9 depict cross sectional views of a three-way control valve of one embodiment.
Figure 9:
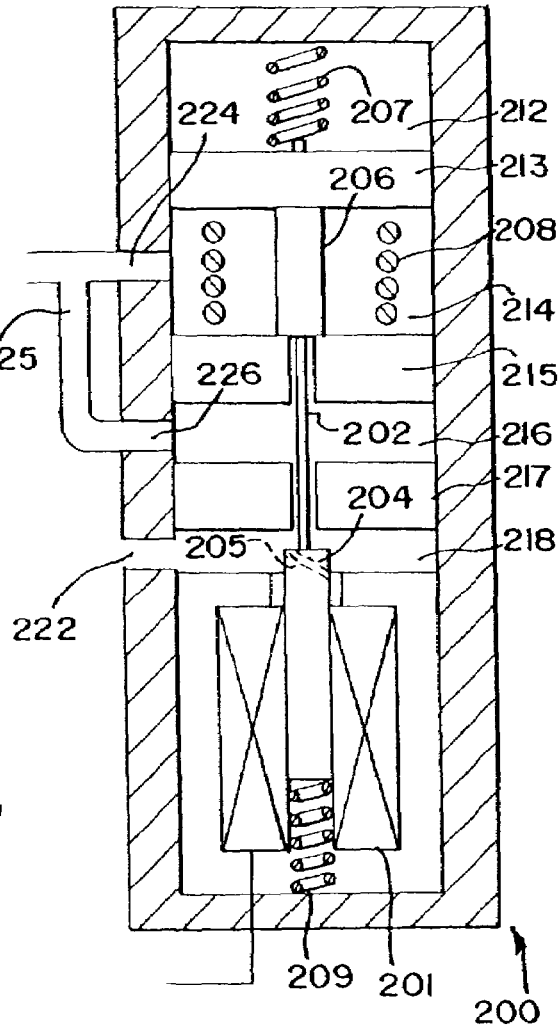

A three way control valve using $P_d$ and $P_a$, and also using $P_c$, is depicted in FIGS. 8 and 9. Three-way control valve 200 is similar in some respects to the four-way control valve described above, but is less complicated. Three-way control valve 200 has a coil 201, stem 202 with flow control elements 204 and 206, a first strong spring 207, second spring 209, and an internal spring 208. Valve body internal walls 215, 217 have orifices to allow passage of stem 202 and also pressures from chambers 214, 216, and 218. Valve 200 receives pressures from orifices 222 ($P_c$), 224 ($P_a$), and 226 ($P_d$). Internal spring 208 may be used as an auxiliary spring in balancing the forces that move valve stem 202 in controlling the valve. Placed between fixed internal wall 215 and movable wall 213, spring 208 may sometimes act to oppose the motion of stem 202 and sometimes act to reinforce the motion of stem 202, depending on the force applied by coil 201 and springs 207, 209.

In communicating pressures from the compressor to the control valve, tubing may be used, or channels internal to the compressor may be used to connect directly to the valve. Thus, discharge pressure may connect from the discharge chamber of the compressor to chamber 216 via orifice 226 and tubing 225. Tubing 225 is desirably large enough to communicate $P_d$ without an appreciable drop in pressure. An auxiliary pressure $P_a$ may result if tubing 225 and orifice 224, communicating between discharge pressure $P_d$ and chamber 214, have diameters small enough to restrict flow and to induce a small pressure drop. Tubing having a diameter of preferably 3–4 mm is sufficient for this purpose. Other tubing having a diameter from about 1–5 mm may also be used.

FIG. 8 depicts the valve in maximum open position, with maximum current to coil 201, and stem 202 and flow control elements 204, 206 in their furthest upward positions, overcoming the force of strong spring 207. Flow control element 204 prevents flow between chambers 218 and 216, while flow control element 206 allows maximum flow or pressure equalization between chambers 216 and 214. In this embodiment, this position minimizes the difference between $P_a$ and $P_d$, and prevents communication between $P_c$ and $P_d$, thus allowing for maximum compressing of refrigerant in the compressor. FIG. 9 depicts the same valve 200, now in the off position. In this position, coil 201 receives the minimum or no current. Strong spring 207 overcomes spring 209, forcing stem 202 downward in FIG. 9, and allowing communication between chambers 216 and 218, but not between chambers 214 and 216. This allows for the minimum possible compression, and tends to equalize the discharge and crankcase pressures, thus moving the swashplate to a position nearly perpendicular to the longitudinal axis of the drive shaft, and parallel or nearly parallel to a plane perpendicular to the longitudinal axis of the drive shaft. In the three-way valve depicted in FIGS. 8 and 9, there may be a small passage between chambers 216 and 218, from about 0.05 mm to about 0.6 mm. The passage is provided as either a passage 227 in chamber wall 217 (see FIG. 8) or a passage 205 in flow control element 205 (FIG. 9). Passages 227 or 205 allow oil from the compressor discharge to return to the crankcase.

With respect to the operation of the solenoid valves in FIGS. 8 and 9, the pressure difference across chamber wall 217 is the discharge pressure $P_d$ minus the crankcase pressure, $P_c$. These two pressures are inversely related. When cooling demand is high, $P_d$ will be high, $P_a$ will be low, and $P_c$ will be low, and $P_c$ will be very close to $P_s$ When cooling demand is low, $P_d$ may be vented to the crankcase through the control valve raising $P_c$, while $P_a$ will drop only little from $P_d$. In this case, therefore, $P_c$ will be high and $P_a$ may be low. In other embodiments, the three-way control valve may use the three chambers for $P_d$, $P_c$, and $P_d$. Springs may be designed with specific spring constants for the pressures and pressure ranges used. It will be appreciated that there are many other ways to use the three-way control valves depicted in FIGS. 8 and 9. For instance, one alternate embodiment may use the three chambers, in order, for $P_s$, $P_c$ and $P_d$, with a single control element to regulate, as desired, the orifice between the chamber with $P_s$ and the chamber with $P_c$, or the orifice between the chamber with $P_c$ and the chamber with $P_d$. The source of the discharge pressure may be the oil separator return line, with the oil return running through the valve, through the $P_c$ chamber, and returning oil to the crankcase. In a preferred embodiment, there may be a small orifice, from about 0.05 mm to about 0.6 mm, between the chamber with $P_d$ and the chamber with $P_c$.

In the example above, the chamber with $P_s$ was used for sensing only. An equivalent is to use a two-way valve, without a chamber for $P_s$, and with appropriate compensation from springs or with appropriate input from the control system, in which the oil returns through the control valve. In one embodiment, there may be a narrow orifice from the oil-return or $P_d$ chamber to the $P_c$ chamber, the orifice as stated above, from about 0.05 mm to about 0.6 mm. It may also be possible to instead place the orifice in the control element that seals the control orifice, as depicted in FIG. 4, such that there is always at least a narrow orifice for oil to return from the oil return line to the crankcase chamber through the valve.

Embodiments with $P_a$ and a Three-Way Valve

Figure 10:
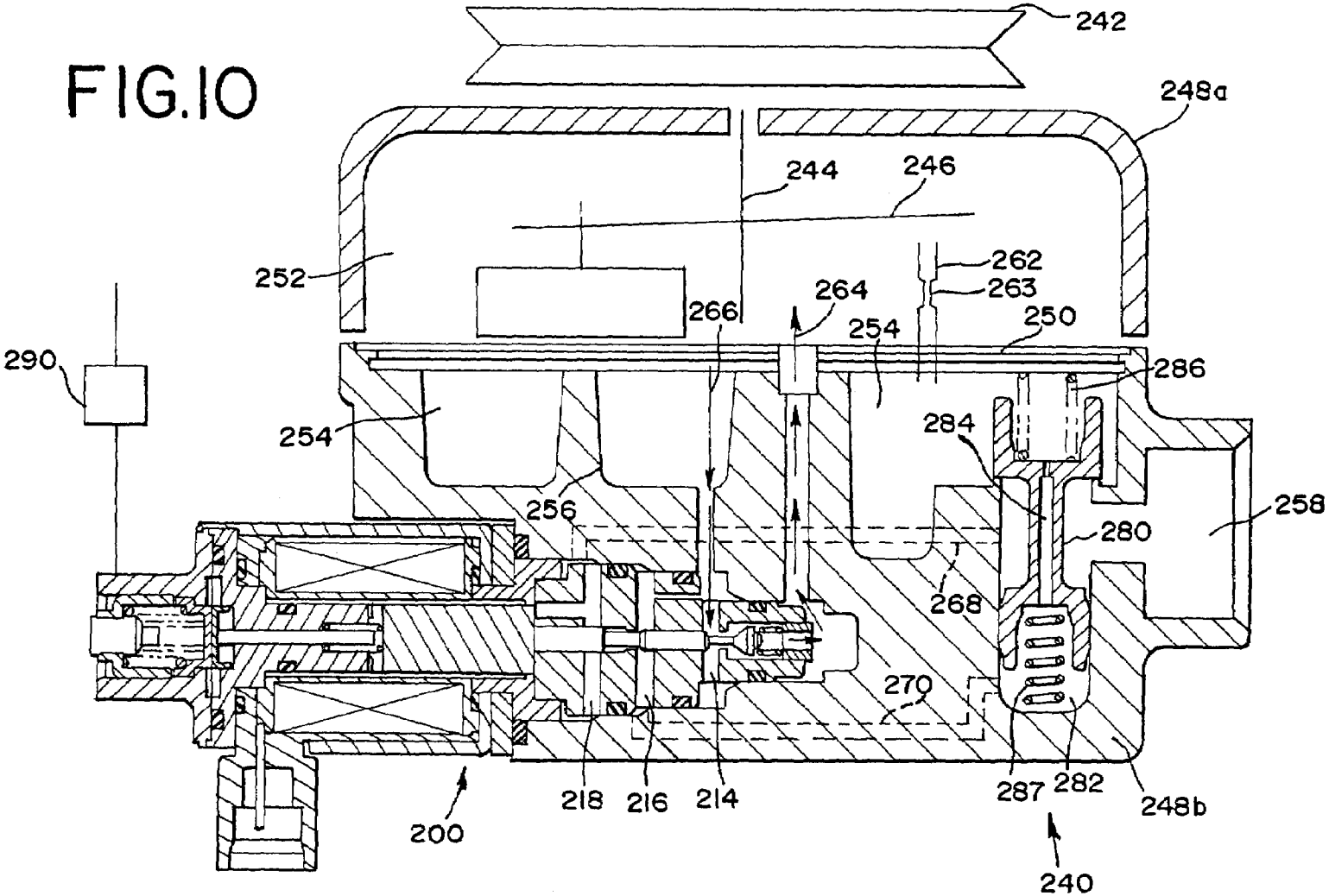
FIGS. 10 and 11 are cross sectional views of further alternative embodiments of a compressor and control system.
Figure 11:
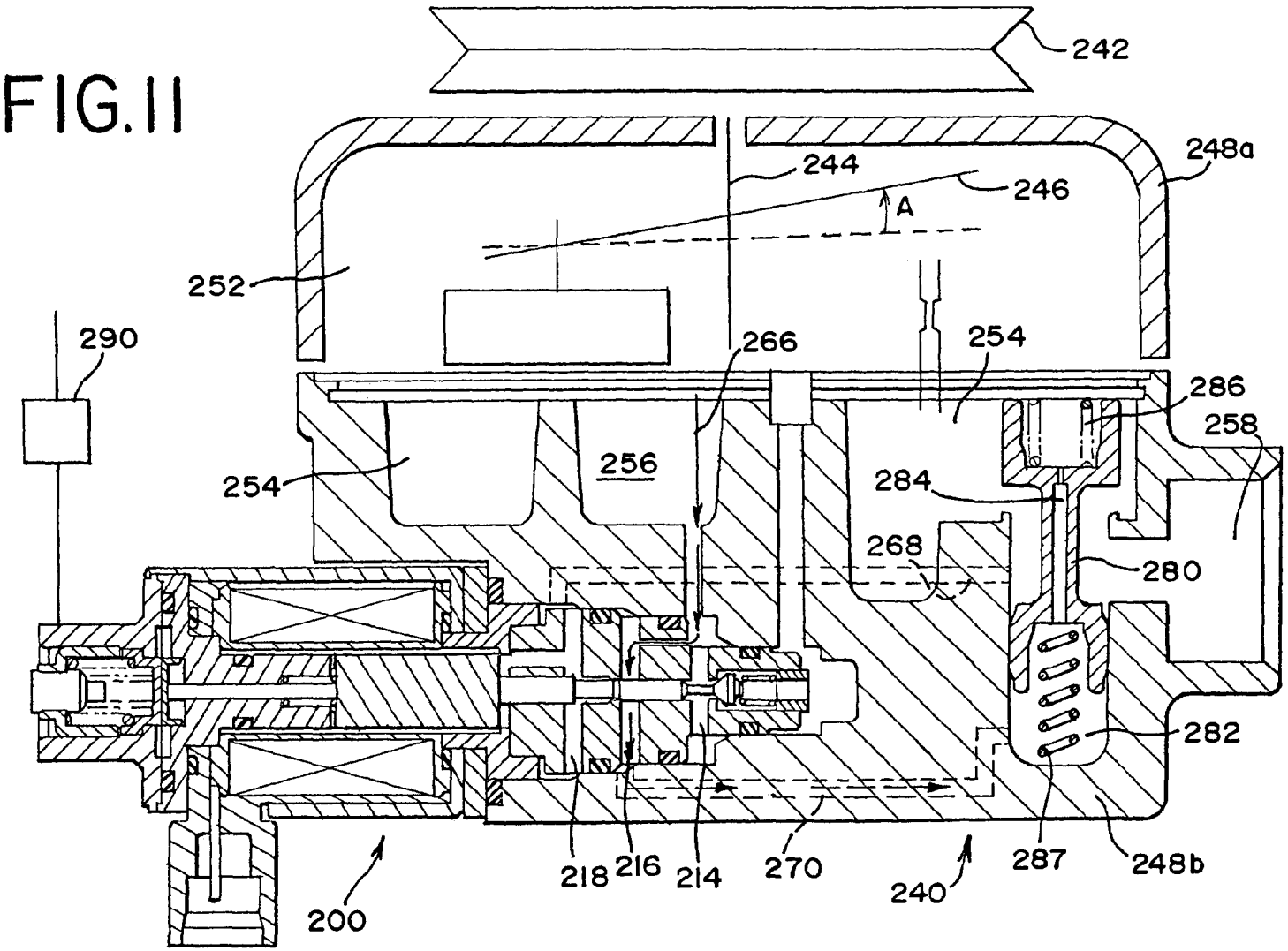

FIGS. 10 and 11 are cross sectional views of a compressor 240 using a three-way control valve 200. FIG. 10 depicts compressor 240 with upper housing 248*a* and lower housing 248*b*, control valve 200, and controller 290, as described above in the description for controller 95. The compressor has a drive sheave 242, drive shaft 244, swash plate 246, shown at a minimum angle to the drive shaft, and valve plate 250, defining a crankcase chamber 252, suction chamber 254 and discharge chamber 256. After refrigerant leaves the discharge chamber and goes to the downstream refrigeration system (not shown), the refrigerant returns from the evaporator at a relatively low pressure, the pressure of the evaporator, to suction port 258. There may also be a passage 262 with a control orifice 263 between suction chamber 254 and crankcase chamber 252.

In the embodiment of FIG. 10, flow from the suction port 258 to the suction chamber 254 is governed by a suction shut-off valve 280 with upstream chamber 282 in compressor lower housing 248*b*. Suction shut-off valve 280 is shown in the closed position, preventing low-pressure refrigerant from passing from suction port 258 to suction chamber 254. To prevent oil starvation, there may also be a small passage or orifice 284 in shut-off valve 280 allowing small amounts of oil to flow from the control valve discharge port, through plumbing 270 to valve 280, and to suction chamber 254. This passage may be from about 0.05 to about 0.6 mm in diameter, preferably about 0.1 to about 0.15 mm. The valve 280 may also have a spring 286 urging the valve closed and a second spring 287 on the opposite side urging the valve open. Spring 286 preferably has a spring constant slightly higher than the spring constant of spring 287, biasing the valve 280 closed.

Line 268 communicates $P_s$ to suction port 258. Line 270 communicates $P_a$ to upstream chamber 282 of shut-off valve 280, thus controlling the position of valve 280. Shut-off valve 280 will thus be biased closed by spring 286 and $P_s$, with spring 287 and $P_a$ opposed, tending to open valve 280. In the embodiment of FIG. 10, valve 200 is open, allowing pressure equalization between $P_d$ and $P_c$, and tending to push the swashplate 246 to a minimum angle, and thus a minimum flow, in FIG. 10.

In FIG. 11, there is more demand for air conditioning, and movement of the internal components has occurred. The position of the valve 200 is close to that depicted in FIG. 8, with no communication between chambers 216 and 218. The discharge pressure is not communicated to the crankcase, but rather is used fully for cooling. As a result, $P_d$ increases, while $P_a$ decreases, overcoming the force of spring 286. Shut-off valve 280 in FIG. 11 moves upward, allowing communication between suction port 258 and suction chamber 254. There will now be a much greater difference between the suction and discharge pressures, and the swashplate will move to a greater angle to the drive shaft of the compressor.

Various embodiments of the invention have been described and illustrated. However, the description and illustrations are by way of example only. Other embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. A variable displacement compressor, comprising:

a compressor housing having a crankcase chamber with a crankcase pressure, a suction chamber with a suction pressure, and a discharge chamber with a discharge pressure, an oil separator in a discharge line of the compressor, the compressor also having a driveshaft, a swashplate connected to and driveable by the driveshaft, a plurality of pistons connected to the swashplate and reciprocating in a plurality of cylinders, wherein a displacement of the compressor is varied by the angle of the swashplate with the drive shaft; and a three-way control valve having a valve body, a valve stem, at least one spring opposing motion of the valve stem, and three chambers in series for receiving three pressures from the variable displacement compressor, one chamber receiving a discharge pressure, one chamber receiving a crankcase pressure, and one chamber receiving an auxiliary pressure from the oil separator, wherein the control valve is operative to change the crankcase pressure and thereby change the displacement of the compressor.

2. The variable displacement compressor of claim 1, wherein the oil separator further comprises tubing and a flow control device to route oil to the crankcase.

3. The variable displacement compressor of claim 2, wherein the flow control device is selected from the group consisting of an orifice and a valve.

4. The variable displacement compressor of claim 1, further comprising a spring within the valve body that acts to open or to close the valve.

5. The variable displacement compressor of claim 1, further comprising a check valve upstream or downstream of the oil separator.

6. The variable displacement compressor of claim 5, wherein the check valve further comprises tubing and a flow control device to route oil to the crankcase.

7. The variable displacement compressor of claim 6, wherein the flow control device is selected from the group consisting of an orifice and a valve.

8. The variable displacement compressor of claim 1, wherein the control valve is an electronic control valve control led by a signal selected from the group consisting of the suction pressure and a temperature from an evaporator of an automotive air-conditioning system.

9. The variable displacement compressor of claim 1, further comprising a suction shut off valve between an evaporator and the suction chamber, the suction shut off valve responsive to a pressure to open or close the suction shut off valve.

10. The variable displacement compressor of claim 9, wherein the pressure to open or close is the auxiliary pressure.

11. The variable displacement compressor of claim 1, further comprising a control system for controlling the control valve, the control system further comprising a microprocessor-based controller, memory operably connected to the controller, and inputs and outputs to and from the controller.

12. The variable displacement compressor of claim 1, further comprising an orifice between the chamber receiving the discharge pressure and the chamber receiving the crankcase pressure.

13. A method of operating a variable displacement compressor according to claim 1, the method comprising:

controlling a displacement of the compressor with a three way valve using a discharge pressure, a crankcase pressure, and an auxiliary pressure from an oil separator;

adjusting the displacement with the three way valve based on a difference between the discharge pressure and the crankcase pressure;

separating oil from a discharge line of the compressor; and routing the oil to a crankcase of the compressor.

14. The method of claim 13, further comprising controlling a flow of the oil to the crankcase based on a signal selected from the group consisting of a suction pressure and an evaporator temperature.

15. The method of claim 13, further comprising sending a signal to a vehicle powertrain controller indicative of a load on the variable displacement compressor.

16. A variable displacement compressor, comprising:

a compressor housing having a crankcase chamber with a crankcase pressure, a suction chamber with a suction pressure, and a discharge chamber with a discharge pressure, the compressor also having a driveshaft, a swashplate connected to and driveable by the driveshaft, a plurality of pistons connected to the swashplate and reciprocating in a plurality of cylinders, and a suction shut off valve between an evaporator and the suction chamber, the suction shut off valve responsive to a pressure to open or close the suction shut off valve, wherein a displacement of the compressor is varied by the angle of the swashplate with the drive shaft; and a three-way control valve having a valve body, a valve stem, at least one spring opposing motion of the valve stem, and three chambers in series for receiving three pressures from the variable displacement compressor, one chamber receiving a discharge pressure, one chamber receiving a crankcase pressure, and one chamber receiving an auxiliary pressure from an oil separator, wherein the control valve is operative to change the crankcase pressure and thereby change the displacement of the compressor.

17. The variable displacement compressor of claim 16, wherein the pressure to open or close is the auxiliary pressure.

* * * * *